US006999703B2

(12) United States Patent
Hays

(10) Patent No.: US 6,999,703 B2
(45) Date of Patent: Feb. 14, 2006

(54) ION TONER CHARGING DEVICE

(75) Inventor: Dan A Hays, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 145 days.

(21) Appl. No.: 10/804,940

(22) Filed: Mar. 19, 2004

(65) Prior Publication Data

US 2004/0184839 A1 Sep. 23, 2004

Related U.S. Application Data

(60) Provisional application No. 60/457,062, filed on Mar. 21, 2003.

(51) Int. Cl.
*G03G 15/08* (2006.01)

(52) U.S. Cl. ..... 399/252

(58) Field of Classification Search ..... 399/252, 399/289

See application file for complete search history.

(56) References Cited

U.S. PATENT DOCUMENTS

| | | | | |
|---|---|---|---|---|
| 2,725,304 A | | 11/1955 | Landrigan | 117/17.5 |
| 4,726,812 A | * | 2/1988 | Hirth | 95/80 |
| 5,656,409 A | | 8/1997 | Christy et al. | 430/120 |
| 5,734,955 A | | 3/1998 | Gruber et al. | 399/266 |
| 5,893,015 A | | 4/1999 | Mojarradi et al. | 399/291 |
| 5,899,608 A | | 5/1999 | Eklund et al. | 399/266 |
| 5,953,571 A | * | 9/1999 | Thompson | 399/290 |
| 6,223,013 B1 | | 4/2001 | Eklund et al. | 399/266 |
| 6,377,768 B1 | | 4/2002 | Hulin et al. | 399/281 |
| 6,597,884 B1 | * | 7/2003 | Miyaguchi et al. | 399/266 |
| 2004/0184840 A1 | * | 9/2004 | Hays | 399/252 |

FOREIGN PATENT DOCUMENTS

| | | | |
|---|---|---|---|
| JP | 58122569 A | * | 7/1983 |
| JP | 59230653 A | * | 12/1984 |
| JP | 58018849 A | * | 2/1993 |

OTHER PUBLICATIONS

Rimai D. S., Ezenyilimba M., Goebel, W. K., Cormier S., and Quesnel D. J., 2002, *J. Imaging Sci. Technol.*, 46 200-207.

Iimura H., Kurosu H., and Yamaguchi T., 2000, *J. Imaging Sci. Technol.*, 44 457-461.

Hays D. A., 1978, *Photogr. Sci. Eng.*, 22 232-235.

Lee M. H. and Ayala J, 1985, *J. Imaging Technol.*, 11 279-284.

Hays D. A., 1988, *Particles on Surfaces 1: Detection, Adhesion and Removal*, Mittal K L, Ed. (New York: Plenum Press) 351-360.

(Continued)

*Primary Examiner*—Quana Grainger
(74) *Attorney, Agent, or Firm*—Lloyd F. Bean, II

(57) ABSTRACT

A device for ion charging airborne toner particles for the development of electrophotographic images is proposed. The ion toner-charging device subjects an airborne stream of toner particles to unipolar gas ions in the presence of an applied alternating electric field. The alternating electric field prevents the charged particles from depositing on the electrodes in the charging zone. The device uniformly charges irregular or spherical shaped toner particles to the Pauthenier charging limit. The device is an interface between various methods for supplying toner to the unit and developing an electrostatic image with ion charged toner.

20 Claims, 5 Drawing Sheets

OTHER PUBLICATIONS

Christy O. D., 1995, *IS&T's NIP 13: Eleventh International Conference on Advances in Non-Impact Printing Technologies* (IS&T, Springfield, VA) 176-179.

Shapiro Y. and Hays D. A., 1999, *Proceedings of the 22nd Annual Meeting of the Adhesion Society* (Panama City, FL.) 28-30.

Feng J. Q. and Hays D. A., 2000, *J. Imaging Sci. Technol.*, 44 19-25.

Adamiak K., Krupa A. and Jaworek A., 1995, *Electrostatics 1995* Inst. Phys. Conf. Ser. 143 (Bristol and Philadelphia: IOP Publishing) 275-278.

Eklund E. A., Wayman W. H., Brillson L. J. and Hays D. A., 1995, *Electrostatics 1995* Inst. Phys. Conf. Ser. 143 (Bristol and Philadelphia: IOP Publishing) 85-92.

* cited by examiner

ION TONER CHARGING DEVICE

This application claims the benefit of provisional patent application No. 60/457,062, filed Mar. 21, 2003.

CROSS-REFERENCE TO RELATED APPLICATIONS

Reference is made to copending U.S. patent application Ser. No. 10/805,064, filed concurrently herewith, entitled "ION TONER CHARGING DEVICE," by Dan A. Hays, the disclosure of which is incorporated herein.

BACKGROUND AND SUMMARY

This invention relates generally to a development apparatus for ionographic or electrophotographic imaging and printing apparatuses and machines, and more particularly is directed to a development system wherein toner is charged by a corona device.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. Toner particles are attracted to the latent image forming a toner powder image on the photoconductive surface. The toner powder image is subsequently transferred to a copy sheet, and finally, the toner powder image is heated to permanently fuse it to the copy sheet in image configuration.

The operating latitude of a powder xerographic development system is determined to a great degree by the ease with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or mono-component (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

In the electrophotographic industry, the phenomenon of triboelectricity is widely used to charge toner particles. Toner charging with ions has a number of advantages including insensitivity to material surface properties, no relative humidity dependence, and reduced toner adhesion. Various methods have been proposed to charge toner with ions. This invention describes a method for uniformly charging both irregular and spherical shaped toner particles.

Triboelectric charging is widely used in the electrophotographic industry to charge toner particles for electrostatic image development and transfer to paper. A Midax printer manufactured by Moore Corporation Limited employs ion charged toner by corotron wires immersed in air fluidized toner [Christy O D 1995 *IS&T's NIP* 13: *International Conference on Advances in Non-Impact Printing Technologies* (IS&T, Springfield, Va.) 176–179]. Acceptance of this technology in the marketplace was limited due to difficulties encountered in being able to fluidize smaller toner desired for high image quality. Considering the advantages of ion charged toner, there remains a need for alternative ion charging methods that are compatible with toner particle sizes in the range of 5 to 15 $\mu$m in diameter. Toner charging with ions has a number of advantages including insensitivity to material surface properties, no relative humidity dependence, and reduced toner adhesion.

Various methods have been proposed to charge toner with ions. For example, U.S. Pat. No. 2,725,304 by Landrigan and Tom describe the charging of toner particles in an air stream by ions emanating from high voltage electrodes. The ion-charged toner was used to powder cloud develop an electrostatic image. U.S. Pat. No. 5,656,409 by Christy describes ion charging of toner by high voltage electrodes in a fluidized bed of toner. Exemplary development systems are disclosed in the in U.S. Pat. No. 6,223,013 issued to E. Eklund, Y. Shapiro, D. Hays and J. Knapp on "Wire-Less Hybrid Scavengeless Development System"; U.S. Pat. No. 5,899,608 issued to E. Eklund, Y. Shapiro and D. Hays on "Ion Charging Development System to Deliver Toner with Low Adhesion". U.S. Pat. No. 5,734,955 issued to R. Gruber and D. Hays on "Development System"; and U.S. Pat. No. 5,893,015 issued to Mojarradi et al on "Flexible donor belt employing a DC traveling wave", all of which are hereby incorporated by reference. As a more recent example, U.S. Pat. No. 6,377,768 by Hulin et al. describes the use of electrostatic powder coating technology to ion charge toner for toning a donor roll that provides a low-disturbance development of an electrographic image. Although the advantages of ion charged toner in electrophotography have been recognized for many years, this method of charging toner has not been adopted by the industry.

Herein a device is described for ion charging airborne toner particles for the development of electrophotographic images. The ion toner-charging device subjects an airborne stream of toner particles to unipolar gas ions in the presence of an applied alternating electric field. The device uniformly charges irregular or spherical shaped toner particles to the Pauthenier charging limit. The device is the interface between various methods for supplying toner to the unit and developing an electrostatic image with ion charged toner. Toner charging by the proposed device is insensitive to toner surface properties, relative humidity dependence. Ion charged toner enables reduced adhesion for improved electrophotographic development, electrostatic transfer and cleaning.

An advantageous feature of the present invention is that utilization of an ion toner charging method for maximum charging of toner particles in an air stream. The ion charged toner can then be used to either directly develop an electrostatic image, tone donor rolls for the development of an electrostatic image, or add charged toner to a conductive two-component developer for toning either donor rolls or directly developing an electrostatic image.

Additional and other aspects of the present invention will become apparent as the following description proceeds and upon reference to the drawings, in which.

For a general understanding of the features of the present invention, reference is made to the drawings, wherein like reference numerals have been used throughout to designate identical elements.

Figure 5:
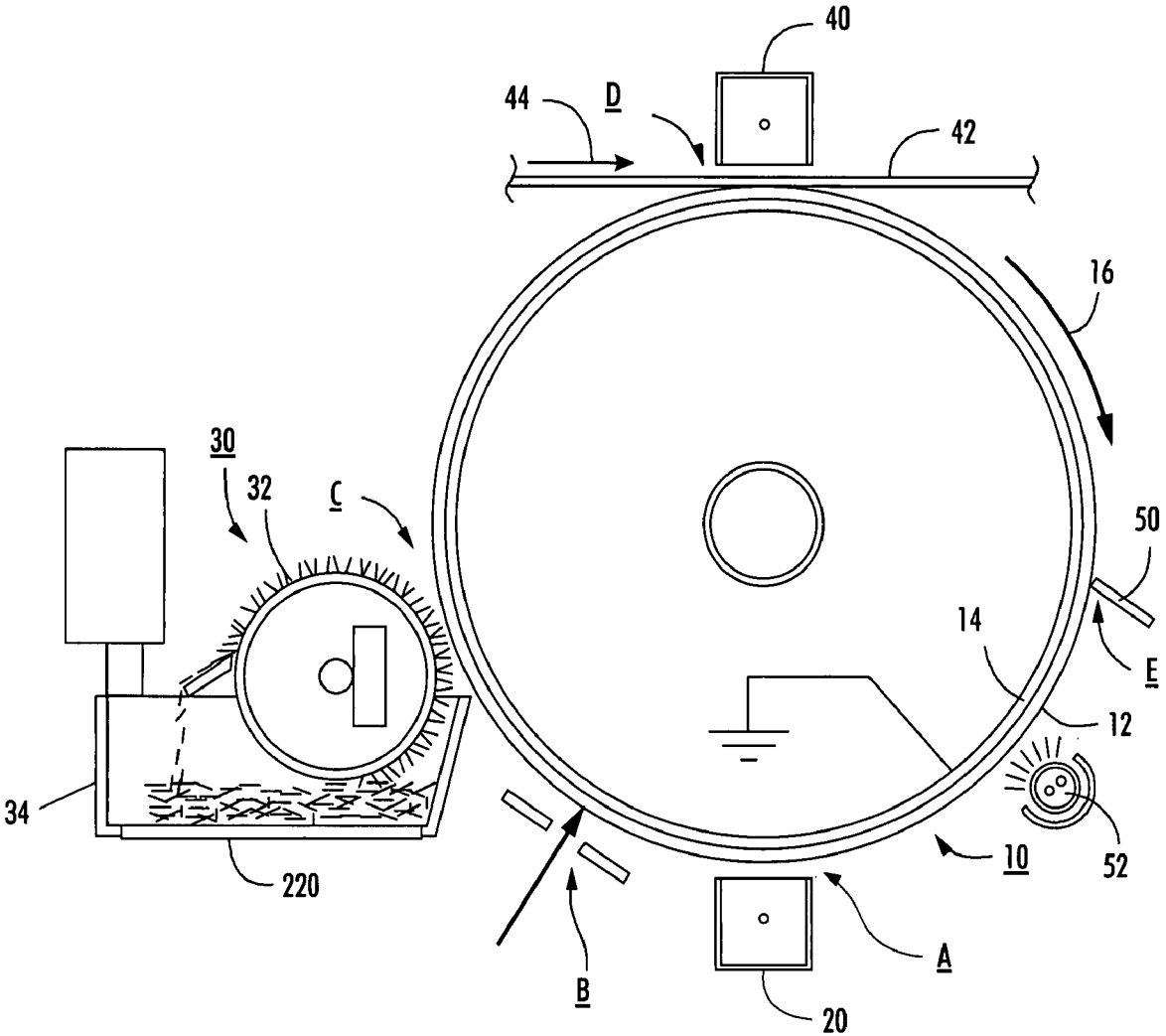
FIG. 5 is a schematic view showing an electrophotographic printing apparatus incorporating the development system of FIG. 4.

Referring initially to FIG. 5, prior to describing the specific features of the present invention, a schematic depiction of the various components of an exemplary electrophotographic reproducing apparatus incorporating the ion toner charging assembly of the present invention is provided. Although the apparatus of the present invention is particularly well adapted for use in an electrophotographic reproducing machine, it will become apparent from the following discussion that the present corona generating device is equally well suited for use in a wide variety of electrostatographic processing machines as well as other systems requiring the use of a corona generating device. In particular, it should be noted that the corona generating device of the present invention, described hereinafter with reference to an exemplary charging system, may also be used in the toner transfer, detack, or cleaning subsystems of a typical electrostatographic copying or printing apparatus since such subsystems also require the use of a corona generating device.

The exemplary electrophotographic reproducing apparatus of FIG. 5 employs a drum including a photoconductive surface 12 deposited on an electrically grounded conductive substrate 14. A motor (not shown) engages with drum 10 for rotating the drum 10 in the direction of arrow 16 to advance successive portions of photoconductive surface 12 through various processing stations disposed about the path of movement thereof, as will be described. Initially, a portion of drum 10 passes through charging station A. At charging station A, a charging device, indicated generally by reference numeral 20, charges the photoconductive surface 12 on drum 10 to relatively high, substantially uniform potential. The charging device in accordance with the present invention will be described in detail following the instant discussion of the electrostatographic apparatus and process.

Once charged, the photoconductive surface 12 is advanced to imaging station B where an original document (not shown) may be exposed to a light source (also not shown) for forming a light image of the original document onto the charged portion of photoconductive surface 12 to selectively dissipate the charge thereon, thereby recording onto drum 10 an electrostatic latent image corresponding to the original document.

One skilled in the art will appreciate that various methods may be utilized to irradiate the charged portion of the photoconductive surface 12 for recording the latent image thereon as, for example, a properly modulated scanning beam of electromagnetic radiation (e.g., a laser beam).

After the electrostatic latent image is recorded on photoconductive surface 12, drum is advanced to development station C where a development system, such as a so-called magnetic brush developer, indicated generally by the reference numeral 30, deposits developing material onto the electrostatic latent image.

Figure 4:
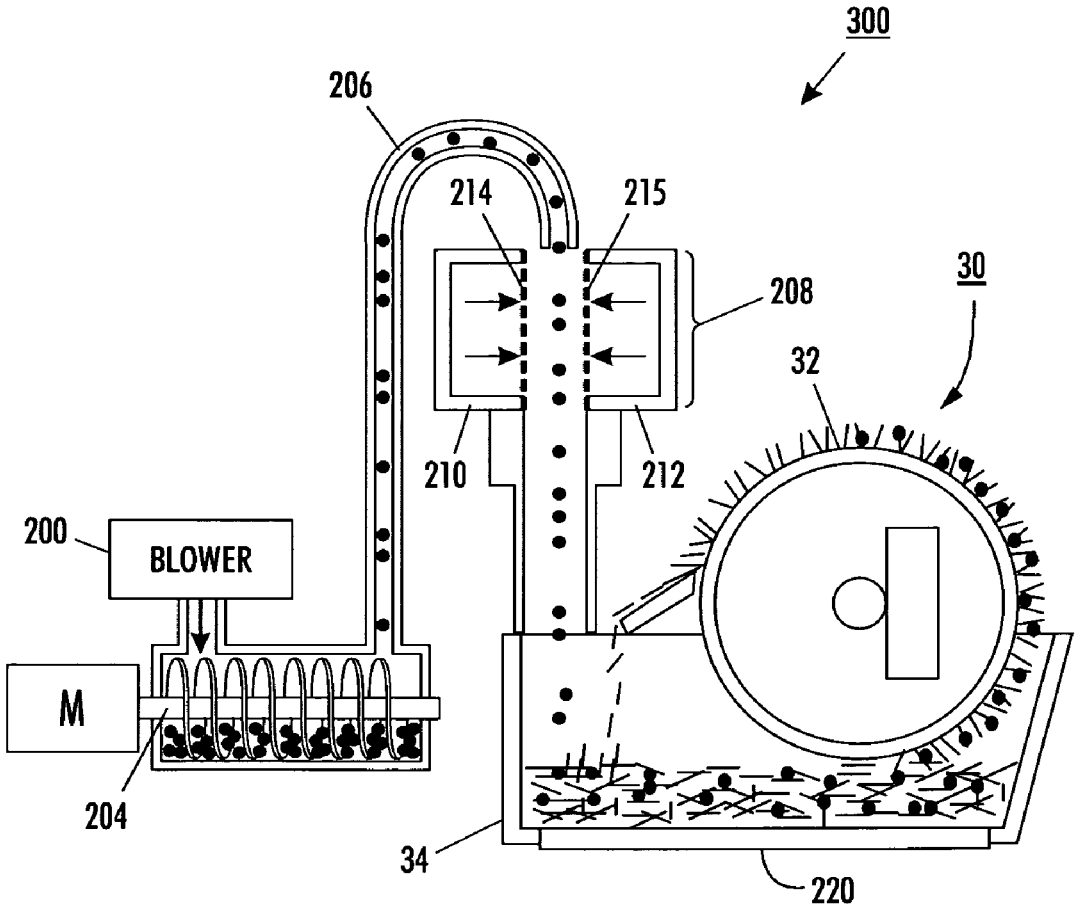
FIG. 4 is a schematic view showing a development system incorporating the present invention.

The exemplary development system 30 shown in FIG. 4 includes a single developer roller 32 disposed in developer housing 34, in which toner particles ion charged by the present invention are mixed with larger, conductive carrier beads in a sump to form a developer that is loaded onto developer roller 32 that has internal magnets to provide developer loading, transport and development. The developer roll 32 having a layer of developer with the ion charged toner particles attached thereto rotates to the development zone whereupon the magnetic brush develops a toner image on the photoconductive surface 12.

It will be understood by those skilled in the art that numerous types of development systems could be substituted for the development system shown herein. For example, the ion charged toner can then be used to either directly develop an electrostatic image, tone donor rolls for the development of an electrostatic image, or add charged toner to a conductive two-component developer for toning either donor rolls or directly developing an electrostatic image.

Referencing now FIG. 5, after the toner particles have been deposited onto the electrostatic latent image for development thereof, drum 10 advances the developed image to transfer station D, where a sheet of support material 42 is moved into contact with the developed toner image in a timed sequence so that the developed image on the photoconductive surface 12 contacts the advancing sheet of support material 42 at transfer station D. A charging device 40 is provided for creating an electrostatic charge on the backside of sheet 42 to aid in inducing the transfer of toner from the developed image on photoconductive surface 12 to the support substrate 42.

It will be recognized after image transfer to the substrate 42, the support material 42 is subsequently transported in the direction of arrow 44 for placement onto a conveyor (not shown) which advances the sheet to a fusing station (also not shown) which permanently affixes the transferred image to the support material 42 thereby for a copy or print for subsequent removal of the finished copy by an operator.

Often, after the support material 42 is separated from the photoconductive surface 12 of drum 10, some residual developing material remains adhered to the photoconductive surface 12. Thus, a final processing station, namely cleaning station E, is provided for removing residual toner particles from photoconductive surface 12 subsequent to separation of the support material 42 from drum 10.

Cleaning station E can include various mechanisms, such as a simple blade 50, as shown, or a rotatably mounted fibrous brush (not shown) for physical engagement with photoconductive surface 12 to remove toner particles therefrom. Cleaning station E may also include a discharge lamp (not shown) for flooding the photoconductive surface 12 with light in order to dissipate any residual electrostatic charge remaining thereon in preparation for a subsequent imaging cycle.

The foregoing description should be sufficient for purposes of the present application for patent to illustrate the general operation of an electrostatographic reproducing apparatus incorporating the features of the present invention.

As described, an electrostatographic reproducing apparatus may take the form of several well known devices or systems. Variations of the specific electrosatographic processing subsystems or processes described herein may be expected without affecting the operation of the present invention.

Applicants have found that efficient transfer of charged toner particles (~10 μm) between surfaces with an applied electric field is important for several process steps in electrophotography. Despite numerous studies of toner adhesion conducted over decades, the interpretations of measurements reported in the literature are not consistent. The relative importance of electrostatic and van der Waals forces is still a subject of debate.

When the van der Waals component of adhesion is minimized with surface additives, the measured particle adhesion of triboelectrically charged toner is observed to increase with increasing toner charge, implying that the electrostatic component of adhesion is dominant. However, the measured adhesion is much greater than the prediction based on an electrostatic image force model for a uniformly charged dielectric sphere. To explain the enhanced electrostatic adhesion, a theory based on nonuniform surface charge distribution on triboelectrically charged toner was proposed.

When irregularly-shaped toner particles with surface additives are charged by corona ions in air fluidized toner, Christy found that the particle adhesion as measured by electric field detachment is much less than the adhesion of triboelectrically charged toner [Christy O D 1995 *IS&T's NIP* 13: *International Conference on Advances in Non-Impact Printing Technologies* (IS&T, Springfield, Va.) 176–179]. This suggests that the electrostatic adhesion of ion charged toner particles can be described by an electrostatic image force model in which irregularly-shaped toner particles are approximated as dielectric spheres with a uniform surface charge density. Theoretically, the electrostatic image force between a uniformly charged dielectric sphere and conductive surface can be described by the equation, $$F_i = -\alpha \frac{Q^2}{16\pi\varepsilon_o R^2}, \tag{1}$$

where Q is the particle charge, R is the average particle radius and $\epsilon_o$ is the permittivity of free space. For a particle of dielectric constant κ=4 (typical for a carbon-loaded polymer), the polarization correction coefficient, α is 1.9. When an electric field is applied to detach the particle, the applied force due to the field, E, is $$F_a = \beta QE - \gamma\pi\epsilon_o R^2 E^2, \tag{2}$$

where β and γ are polarization correction coefficients. For κ=4, we have β=1.6 and γ=0.99. When the strength of detachment electric field is low as in the case of ion-charged toner, the second term on the right side of Eq. (2) can be neglected. When the sum of the forces from Eqs. (1) and (2) (which gives the net electrostatic force) is greater than the non-electrostatic adhesion such as the van der Waals force $F_{NE}$, particle detachment will occur at a detachment electric field, $E_d$, of [Feng J Q and Hays D A 2000 *J. Imaging Sci. Technol.,* 44 19–25]

$$E_d \cong \frac{\alpha Q}{\beta 16\pi\varepsilon_o R^2} + \frac{F_{NE}}{\beta Q}. \tag{3}$$

For the ion-charged toners studied by Christy in which Q=13 fC and R=6 μm, the calculated detachment field from Eq. (3) is 1.0 V/μm with $F_{NE}$ assumed to be negligible. This is in reasonable agreement with the measured median detachment field of 0.7 V/μm. However, Christy's measurements were conducted with approximately a monolayer of toner whereas Eq. (3) is for an isolated particle. Due to fringe electric fields from neighboring charged particles, a monolayer of toner with a uniform surface charge density should have enhanced toner adhesion. About a five-fold increase in the detachment electric field was found by Shapiro and Hays based on calculations for a hexagonal, close-packed array of uniformly charged dielectric spheres [Shapiro Y and Hays D A 1999 *Proceedings of the 22nd Annual Meeting of the Adhesion Society* (Panama City, Fla.) 28–30].

The toner ion charging device described in this Invention Disclosure for applications to electrophotographic systems is motivated by a desire to understand the reason for the very low electric field required to detach a monolayer of toner particles charged by corona ions in a fluidized bed of toner, as reported by Christy. Electric field detachment measurements are presented on airborne toner charged by corona ion currents in an alternating electric field. This particle charging method has been widely studied for electrostatic precipitator and electrostatic powder coating applications [Adamiak K, Krupa A and Jaworek A 1995 *Electrostatics* 1995 Inst. Phys. Conf. Ser. 143 (Bristol and Philadelphia: IOP Publishing) 275–278].

An embodiment of the present invention combines a miniaturized version of an ion charging apparatus with a toner cloud delivery system.

Figure 1:
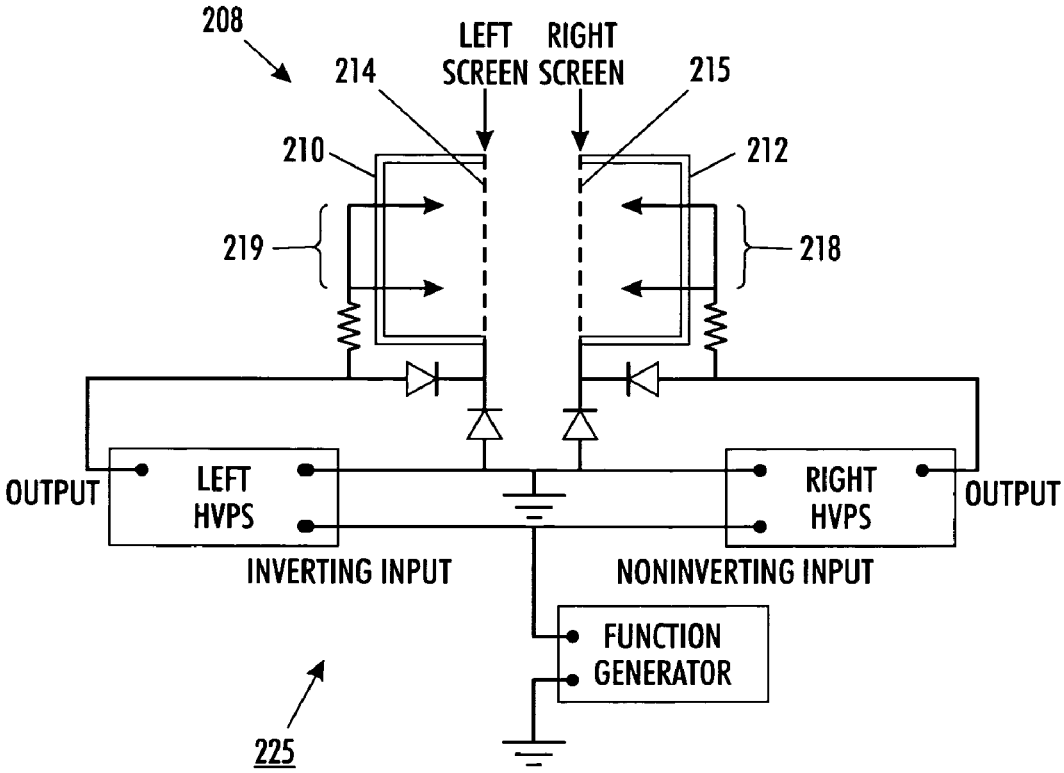
FIG. 1 shows a schematic of the ion-charging device used to charge toner particles employing the principles of the present invention.

An apparatus for ion-charging toner particles in an alternating electric field is shown in FIG. 1. If particles entrained in an air stream are subjected to unipolar corona ions in the presence of an applied electric field E, each particle of radius R and dielectric constant κ will acquire a maximum charge given by the Pauthenier equation $$Q_{\max} = 12\pi\varepsilon_o R^2 E \frac{\kappa}{\kappa+2}. \tag{4}$$

Recent studies by Adamiak, et al. describe an apparatus and theoretical analysis of ion particle charging in an alternating electric field.

FIG. 1 shows a schematic of the apparatus 208 for charging toner particles prior to being delivered to a development delivery device. The corona ion generating units are so-called scorotrons 210 and 212 widely utilized in electrophotography. The coronodes consist of two pin arrays 218 and 219 with corona emitting points. The gap between the left and right screens 214 and 215 is 8 mm, and the length of the ion-charging zone is 2.9 cm. The coronodes and screens are connected to high voltage power supplies (HVPS) 225 through a network of high voltage (10 kV) diodes and resistors (1.5 MΩ). A sine or square-wave function generator is connected to a left and right high-voltage power supplies (HVPS) set at a peak voltage of 8 kV. By connecting the left HVPS to an inverting input and the right HVPS to a noninverting input, the AC voltage of the left HVPS is 180 degrees out of phase with respect to the right HVPS. When the left HVPS is at sufficiently high negative voltage, the left coronodes generate negative ions since the diode between the coronodes and screen is open-circuited and the diode connecting the left screen to ground is short-circuited.

Meanwhile, there is no corona emission from the right coronodes and screen since the diodes isolate both elements from ground at the same potential. This electric field causes negative ions to flow from the left scorotron into the gap where toner particles are entrained in an air stream. While an electrostatic force tends to push the charged particles towards the right screen, the polarities of the power supplies are switched during the next half cycle before the particles deposit on the right screen. During the next half cycle, the right coronodes emit negative ions when the right screen is at ground potential while the left coronodes and screen are at a high positive potential. Thus, the toner particles accumulate additional negative charge as they drift towards the left screen. With increasing cycles, the particles acquire more charge until the Pauthenier charging limit is reached.

Figure 2:
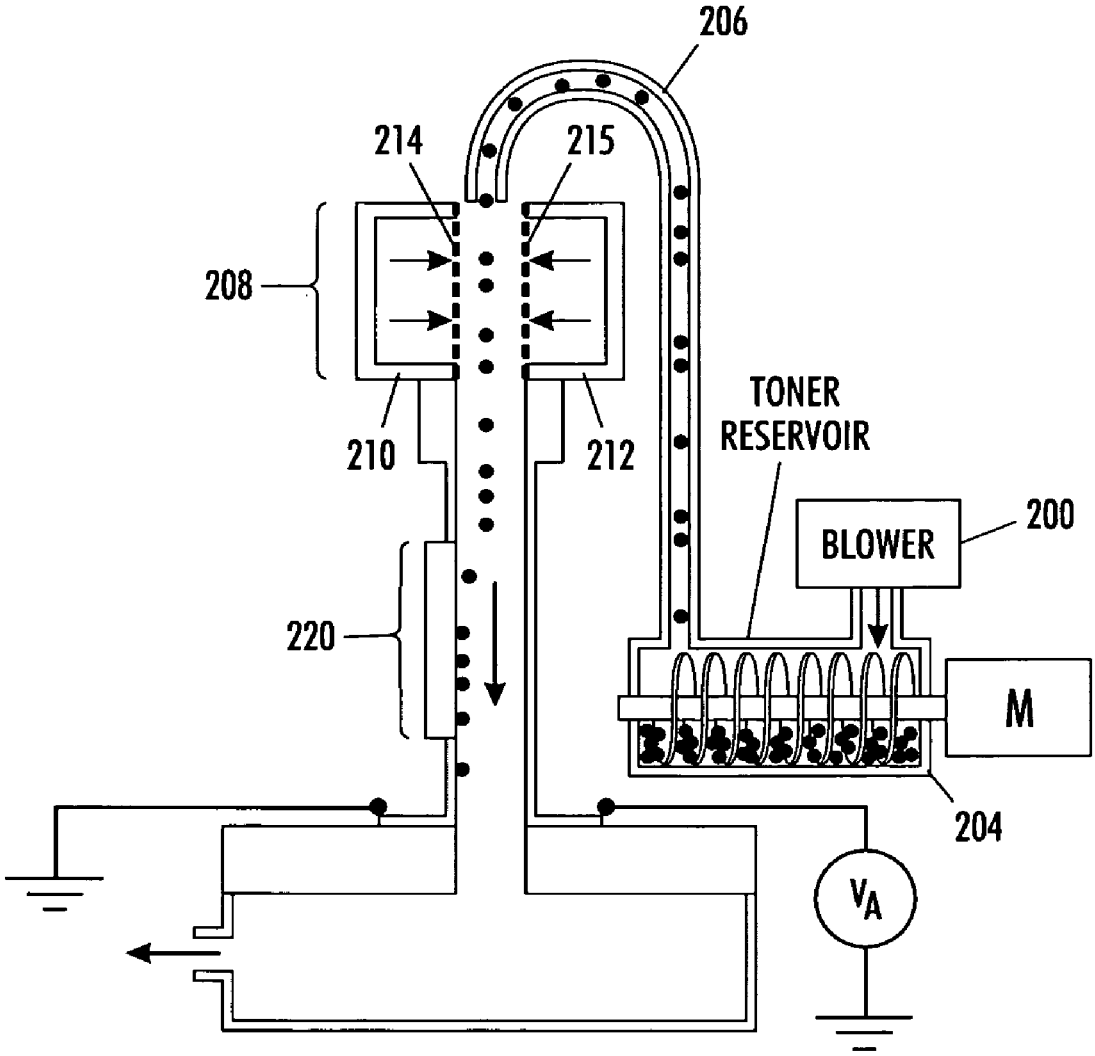
FIG. 2 shows a schematic test fixture for delivering, charging and collecting toner.

FIG. 2 shows a schematic apparatus for delivering, charging and collecting toner of the present invention. A blower 200 generates an airborne stream in a toner reservoir. Dispenser 204 dispenses toner particles in the airborne stream so that the toner particles are entrained in the airborne stream in the toner reservoir. Dispenser 204 includes a brush rotated by a motor. Toner particles in the air stream are transported to an ion-charging zone 208 via pipe 206. The ion charging zone 208 subjects the airborne stream of toner particles to unipolar gas ions. Ion charging zone 208 includes a first charging device 210 and a second charging device 212 opposed from the first charging device 210 so that the airborne stream of toner particles are transported through the ion-charging zone 208 between the first charging device 210 and the second charging device 212. After the particles are uniformly charged with ions, the toner can be deposited onto an electrode 220 that is held at ground potential but facing an opposing biased electrode held at a potential controlled by a DC power supply, $V_A$. The collected charged toner particles can be used to either measure the adhesion properties by electric field detachment measurements.

FIG. 2 provides a schematic of the complete apparatus for delivering, charging and collecting toner for electric field detachment measurements. Toner is placed in a reservoir that contains a brush slowly rotated by a motor (M). An air stream entrains toner particles for delivery to the ion-charging device through a pipe and narrow slit centered over the charging device.

After exiting the ion-charging zone, the toner enters a collection zone which is about (17 cm long) in which a biased electrode is spaced 1.2 cm from a grounded toner-collecting electrode. An electrostatic force acting on the charged toner causes deposition onto the grounded electrode. The grounded electrode consists of a thin brass sheet with a rectangular aperture. The aperture prevents toner deposition on the perimeter of the collecting plate where a dielectric shim is placed for electric field detachment measurements. Toner is deposited over a rectangular area that is 5.1 cm high and 6.3 cm wide.

A vacuum is supplied to a plenum under the apparatus to provide airflow through the ion charging and toner collecting zones. The air speed measured with a hot-wire anemometer is 0.5 m/s at the entrance of the charging zone and 2.5 m/s at the exit of the collecting zone. The large differential in air speeds is due to air being drawn in through slots in the plastic shield of the scorotron devices.

For initial measurements, a toner similar to that used by Christy was chosen so that his results can be compared to the present measurements. The black pigmented, irregularly shaped toner with a median volume diameter of 11.4 $\mu$m contained surface additives to minimize the van der Waals force. The toner was placed in the toner reservoir, delivered to the charging device in the form of a toner cloud with an air stream, ion charged in the alternating electric field apparatus, and deposited on the collecting plate with a bias of $V_A$=−1000 V on the opposing electrode. The charge-to-mass ratio, Q/M, of toner deposited on the collecting plate was approximately −5 $\mu$C/gm for a HVPS peak AC voltage setting of 8 kV at a frequency of 430 Hz. From Eq. (4), the maximum Q/M is predicted to be $$Q/M_{\max} = \frac{9\varepsilon_o E}{\rho R}\frac{\kappa}{\kappa+2}, \tag{5}$$

where ρ is the toner density of 1.1 gm/cm$^3$. For a peak electric field of E=1 V/$\mu$m, R=5.7 $\mu$m and κ=4, the calculated $Q/M_{max}$ is −8.5 $\mu$C/gm. The calculated value based on spherical rather than irregular-shaped particles is in reasonable agreement with the measured toner particle charge considering that no attempt was made to optimize the ion-charging conditions.

Figure 3:
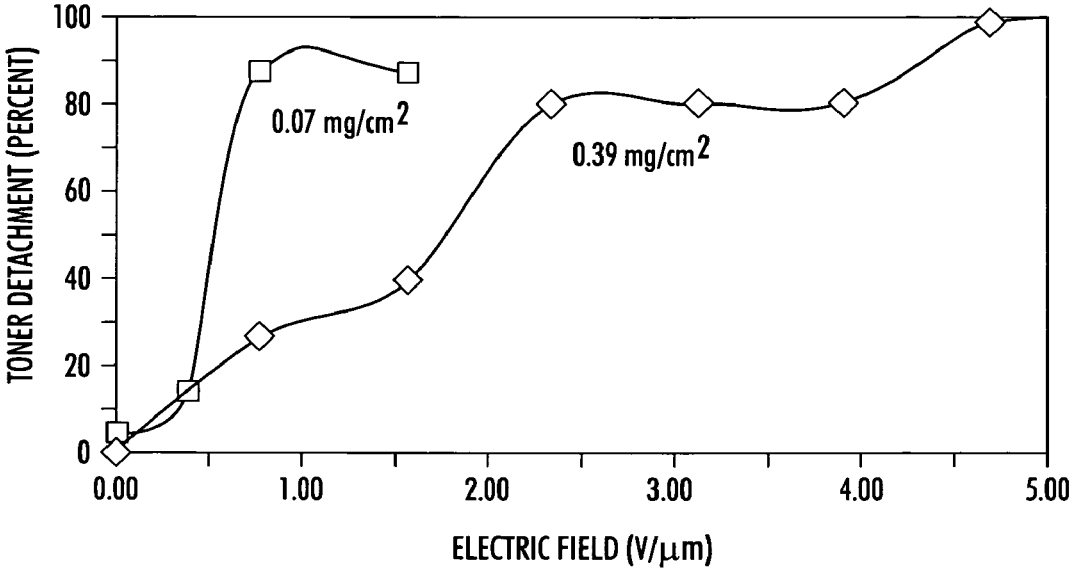
FIG. 3 shows experimental data obtained using the test fixture of FIG. 2.

FIG. 3 shows typical curves for the cumulative toner detachment versus applied electric field strength for initial donor electrode toner densities of 0.07 and 0.39 mg/cm$^2$. Monolayer coverage corresponds to 0.76 mg/cm$^2$ for a hexagonal close-packed array of 11.4 $\mu$m diameter toner. Aluminum donor and receiving electrodes are spaced by a dielectric shim at the electrode edges. The gap between the donor and receiver electrodes was calculated to be 55 $\mu$m from a capacitance measurement. For toner coverage of 0.07 mg/cm$^2$, the particles are expected to be isolated on the average although clustering occurs since the toner deposition is somewhat uneven. The median magnitude of detachment electric field for a low toner coverage is about 0.5 V/$\mu$m. This is quite close to the calculated value of 0.32 V/$\mu$m from Eq. (3) for an isolated sphere with $F_{NE}$ neglected and Q=−3.9 fC corresponding to 11.4 $\mu$m diameter toner with a Q/M of −5 $\mu$C/gm. If $F_{NE}$ is taken into account, Eq. (3) can also be used to estimate the upper limit of the van der Waals force. Thus, we obtain $\beta QE_d$~3.1 nN, $|F_i|$~2.0 nN (cf. Eq. (1)), and $F_{NE}$~1.1 nN for Q=−3.9 fC, $E_d$=−0.5 V/$\mu$m, and R=5.7 $\mu$m at κ=4. (The magnitude of the second term on the right side of Eq. (2) of about 0.2 nN is indeed negligible to a first approximation.) For toner coverage near a monolayer, the median detachment electric field is about 2 V/$\mu$m. The higher median detachment electric field is consistent with the theory accounting for the fringe electric fields from neighboring charged particles, which yields a detachment electric field of 1.7 V/$\mu$m [Shapiro Y and Hays D A 1999 *Proceedings of the 22nd Annual Meeting of the Adhesion Society* (Panama City, Fla.) 28–30]. The detachment curves exhibit stepwise detachment behavior that can be attributed to an "unzipping" of neighboring toner.

The adhesion of ion-charged toner is significantly lower than that of triboelectrically charged toner with median detachment electric fields typically at 10 to 15 V/$\mu$m [10].

Furthermore, the median electric field detachment of ion-charged toner depends on surface coverage as expected for uniformly charged particles. The measured detachment fields are in reasonable agreement with theoretically calculated values. The higher detachment fields for higher toner coverage are due to fringe electric fields from neighboring charged particles.

In recapitulation, a device for ion charging airborne toner particles for the development of electrophotographic images is proposed. The ion toner-charging device subjects an airborne stream of toner particles to unipolar gas ions in the presence of an applied alternating electric field. The alternating electric field prevents the charged particles from depositing on the electrodes in the charging zone. The device uniformly charges irregular or spherical shaped toner particles to the Pauthenier charging limit. The device is an interface between various methods for supplying toner to the unit and developing an electrostatic image with ion charged toner. Examples of methods for supplying toner to the device include entrainment of particles in air stream and or traveling electric field conveyor from a toner reservoir. Examples of methods for developing an electrostatic image include directly develop the electrostatic image, toning donor rolls for the development of an electrostatic image, or adding charged toner to a conductive two-component developer for toning either donor rolls or directly developing an electrostatic image. Toner charging by the proposed device is insensitive to toner surface properties, relative humidity dependence. Ion charged toner enables reduced adhesion for improved electrophotographic development, electrostatic transfer and cleaning.

The examples stated in this invention are representative of the concept. Additional implementations using this concept will be apparent to those trained in the art.

While the invention has been described in detail with reference to specific and preferred embodiments, it will be appreciated that various modifications and variations will be apparent to the artisan. All such modifications and embodiments as may occur to one skilled in the art are intended to be within the scope of the appended claims.

What is claimed is:

1. An apparatus for charging toner particles prior to being delivered to a development delivery device, comprising:

a blower for generating an airborne stream in a chamber;

a dispenser for dispensing toner particles in the airborne stream so that the toner particles are entrained in the airborne stream in the chamber;

means for subjecting the airborne stream of toner particles to unipolar gas ions at an ion charging zone in said chamber, said subjecting means includes subjecting includes: a first charging device, positioned on a wall of said chamber in said ion charging zone, for charging the airborne stream of toner particles with; and a second charging device opposed from said first charging device so that the airborne stream of toner particles transported to the ion-charging zone between the first charging device and the second charging device.

2. The apparatus according to claim 1, wherein the subjecting means uniformly charges irregular or spherical shaped toner particles in the airborne stream to a Pauthenier charging limit.

3. The apparatus according to claim 1, further comprising a power source for applying a first AC voltage bias to the first charging device.

4. The apparatus according to claim 3, wherein the power source applies a second AC voltage bias to the second charging device to generate an applied alternating electric field in said ion charging zone to prevent toner particles from the airborne stream of toner particles from accumulating on said first charging device and second charging device.

5. The apparatus according to claim 4, wherein the second AC voltage bias to the second charging device is 180 degrees out of phase from the first AC voltage.

6. The apparatus according to claim 1, further comprising means for collecting the charged toner particles in a collection area to be subsequently delivered to the development delivery device.

7. The apparatus according to claim 1, wherein the first charging device and the second device includes a scorotron having a screen grid and a corona emitting electrode.

8. The apparatus according to claim 7, wherein the screen grid of the first charging device is about 8 mm from the screen grid of the second charging device.

9. The apparatus according to claim 1, wherein the ion-charging zone is about 2.9 cm long.

10. The apparatus according to claim 1, wherein the power source applies voltage of about 8 kV peak.

11. An electrostatic printing machine having an apparatus for charging toner particles prior to being delivered to a development delivery device, comprising a blower for generating an airborne stream in a chamber;

a dispenser for dispensing toner particles in the airborne stream so that the toner particles are entrained in the airborne stream in the chamber;

means for subjecting the airborne stream of toner particles to unipolar gas ions at an ion charging zone in said chamber, said subjecting means includes subjecting includes: a first charging device, positioned on a wall of said chamber in said ion charging zone, for charging the airborne stream of toner particles with; and a second charging device opposed from said first charging device so that the airborne stream of toner particles transported to the ion-charging zone between the first charging device and the second charging device.

12. The apparatus according to claim 11, wherein the subjecting means uniformly charges irregular or spherical shaped toner particles in the airborne stream to a Pauthenier charging limit.

13. The apparatus according to claim 11, further comprising a power source for applying a first AC voltage bias to the first charging device.

14. The apparatus according to claim 13, wherein the power source applies a second AC voltage bias to the second charging device to generate an applied alternating electric field in said ion charging zone to prevent toner particles from the airborne stream of toner particles from accumulating on said first charging device and second charging device.

15. The apparatus according to claim 14, wherein the second AC voltage bias to the second charging device is 180 degrees out of phase from the first AC voltage.

16. The apparatus according to claim 11, further comprising means for collecting the charged toner particles in a collection area to be subsequently delivered to the development delivery device.

17. The apparatus according to claim 11, wherein the first charging device and the second device includes a scorotron having a screen grid and a corona emitting electrode.

18. The apparatus according to claim 17, wherein the screen grid of the first charging device is about 8 mm from the screen grid of the second charging device.

19. The apparatus according to claim 11, wherein the ion-charging zone is about 2.9 cm long.

20. The apparatus according to claim 11, wherein the power source applies voltage of about 8 kV peak.

* * * * *